US009051734B2

(12) United States Patent
Dupuy et al.

(10) Patent No.: US 9,051,734 B2
(45) Date of Patent: Jun. 9, 2015

(54) ACOUSTIC SOUND REFLECTOR

(71) Applicant: Rudolph Dupuy, Tappan, NY (US)

(72) Inventors: Rudolph Dupuy, Tappan, NY (US); Rolf Nobbe, Queens, NY (US)

( * ) Notice: Subject to any disclaimer, the term of this patent is extended or adjusted under 35 U.S.C. 154(b) by 0 days.

(21) Appl. No.: 14/180,324

(22) Filed: Feb. 13, 2014

(65) Prior Publication Data

US 2014/0224570 A1 Aug. 14, 2014

Related U.S. Application Data

(60) Provisional application No. 61/764,145, filed on Feb. 13, 2013.

(51) Int. Cl.
*G10K 11/00* (2006.01)
*E04B 1/99* (2006.01)

(52) U.S. Cl.
CPC ..... *E04B 1/99* (2013.01)

(58) Field of Classification Search
CPC ..... G10K 11/20
USPC ..... 181/175, 30
See application file for complete search history.

(56) References Cited

U.S. PATENT DOCUMENTS

| | | | | | |
|---|---|---|---|---|---|
| 4,190,739 | A * | 2/1980 | Torffield | 381/305 |
| 4,701,951 | A * | 10/1987 | Kash | 381/304 |
| 5,569,888 | A * | 10/1996 | Kamani et al. | 187/317 |
| 5,764,782 | A * | 6/1998 | Hayes | 381/160 |
| 8,028,791 | B2 * | 10/2011 | Kliegle et al. | 181/30 |
| 8,162,099 | B2 * | 4/2012 | Nakaguro et al. | 181/175 |
| 2001/0023792 | A1 * | 9/2001 | Noselli | 181/179 |
| 2006/0060420 | A1 * | 3/2006 | Freiheit | 181/287 |
| 2011/0024225 | A1 * | 2/2011 | Stephenson et al. | 181/30 |

* cited by examiner

*Primary Examiner* — Forrest M Phillips

(57) ABSTRACT

An acoustical reflector is provided. The reflector includes a top end, a bottom end, a first side, a second side, a front surface, and a rear surface. The reflector may further include a plurality of reflector rows, such as vertical reflector rows. Each reflector row may be formed from the top end to the bottom end and is substantially parallel relative to one another. The plurality of reflector rows may from a concave shape on the front surface of the reflector from the first side to the second side.

16 Claims, 3 Drawing Sheets

ACOUSTIC SOUND REFLECTOR

CROSS-REFERENCE TO RELATED APPLICATION

This application claims the benefit of priority of U.S. provisional application No. 61/764,145, filed Feb. 13, 2013, the contents of which are herein incorporated by reference.

BACKGROUND OF THE INVENTION

The present invention relates to a reflector and, more particularly, to a sound reflecting device.

Currently, back waves caused by sound waves reflecting off of back walls may distort sounds and cause large time smears. Diffusers or absorbers may be used to prevent this but they have a limited effect. Diffusers and absorbers do not prevent the back wall reflections. Further, diffusers usually scatter the waves back into the room but the phase and delay factors are not addressed. The absorbers may partially absorb the back waves but do not restore the time and phase.

As can be seen, there is a need for a device that captures and reflects back waves to prevent time smears.

SUMMARY OF THE INVENTION

In one aspect of the present invention, a reflector comprises: a first side, a second side, a top end, a bottom end, a front surface, and a rear surface, and a plurality of reflector rows wherein each row is formed from the top end to the bottom end, and is substantially parallel relative to one another, wherein the plurality of reflector rows form a concave shape on the front surface from the first side to the second side.

In another aspect of the present invention, a method of restoring the phase and time of sound waves comprises: providing a reflector comprising a plurality of reflector rows forming a concave shaped front surface; positioning the reflector in between at least a first speaker and a second speaker; and aligning the concave shaped front surface with the acoustic center of the first speaker and the second speaker.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention may be an acoustical device or a reflector. The present invention includes a series of reflecting vertical surfaces placed in alignment with the acoustic center of speakers, (Z axis) and equidistant to a listener (X and Y axes). The present invention may restore the phase and time of the waves radiating toward the wall behind the speakers. The device may capture the back waves and reflect them with little to zero delay. This may reduce time smears of the first arrival waves at the listener's position.

The acoustical device once placed at a determined position between a pair of speakers, acts to eliminate the negative (destructive) effect of the back wall reflection interferences which may be caused by differences in arrival times. By equalizing the path differences, the device reflects the back waves without time distortions, in phase and time synch with the right and left speaker reducing the time smear of the first arrival waves experienced by the listener. Methods of mounting the reflector and methods of measuring with a laser may alter and add to the functionality of the present invention.

Figure 1:
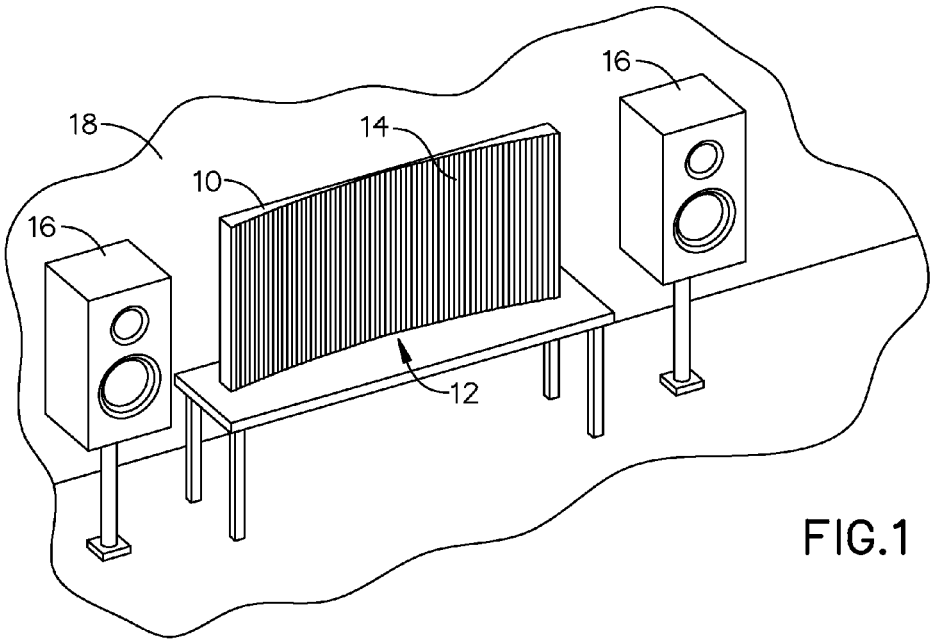
FIG. 1 is a perspective view of the present invention shown in use.
Figure 2:
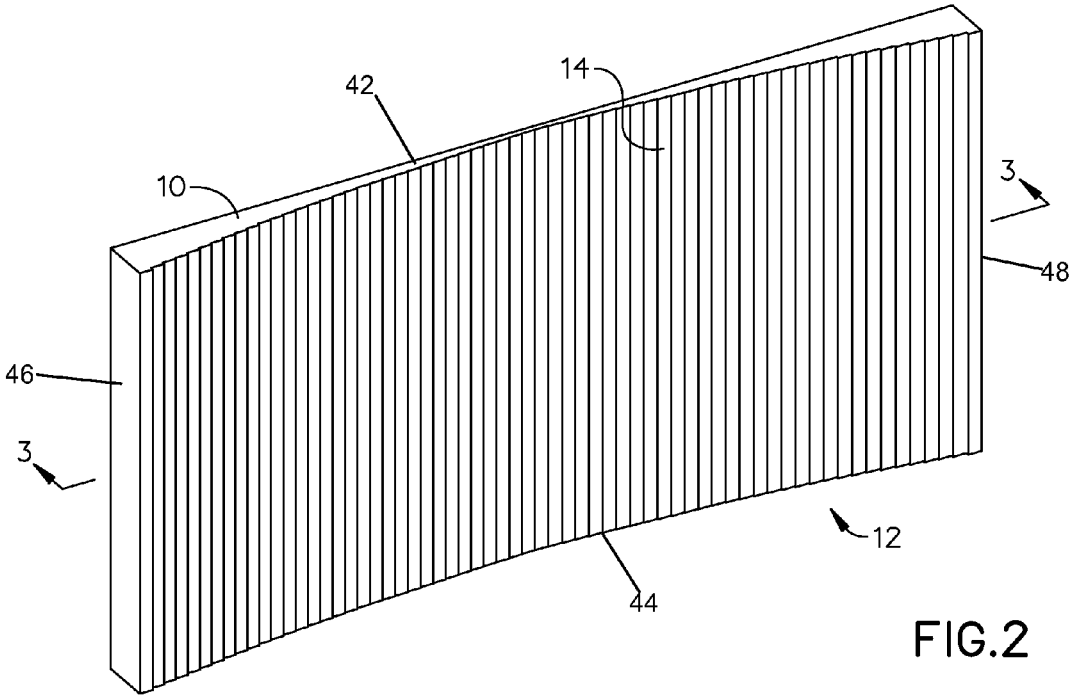
FIG. 2 is a perspective view of the present invention.
Figure 3:
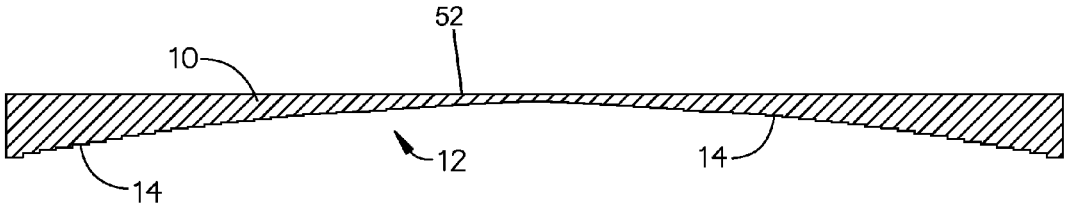
FIG. 3 is a section view of the present invention taken along line 3-3 in FIG. 2.
Figure 4:
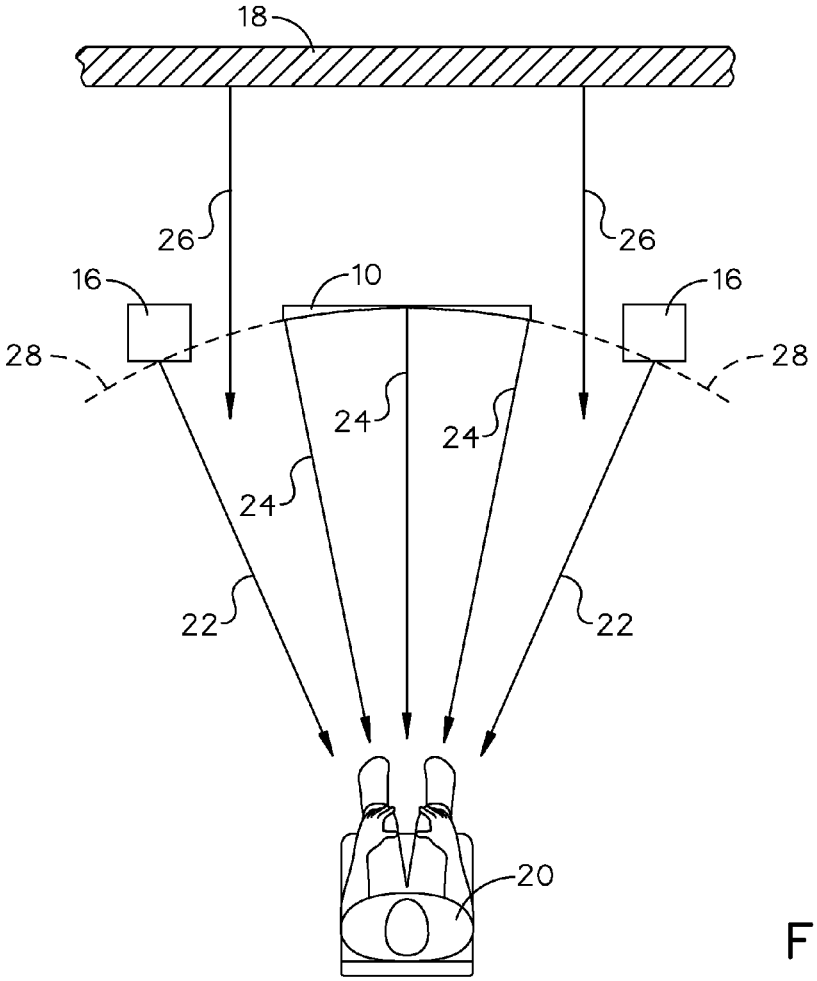
FIG. 4 is a schematic view of the present invention.
Figure 5:
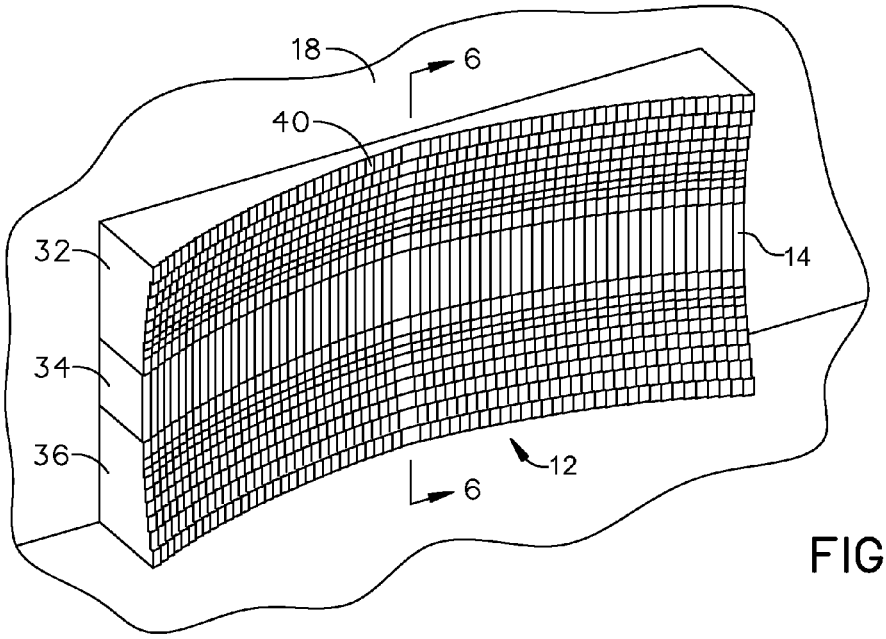
FIG. 5 is a perspective view of an alternate embodiments of the present invention shown in use.
Figure 6:
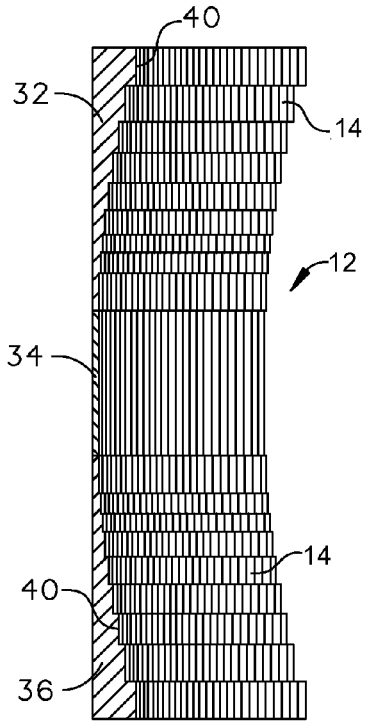
FIG. 6 is a section view of the present invention taken along line 6-6 in FIG. 5.

Referring now to FIGS. 1 through 6, the present invention includes an acoustical reflector 10. The reflector 10 includes a top end 42, a bottom end 44, a first side 46, a second side 48, a front surface 12, and a rear surface 52. The reflector 10 may further include a plurality of reflector rows 14, such as vertical reflector rows 14. Each reflector row 14 is formed from the top end 42 to the bottom end 44 and is substantially parallel relative to one another. The plurality of reflector rows 14 may from a concave shape on the front surface 12 of the reflector 10 from the first side 46 to the second side 48. In certain embodiments, each reflector row 14 comprises a face section and a riser section. The face section of each reflector row 14 may be along a substantially parallel plane relative to one another.

In certain embodiments, the reflector 10 may be made of a series of vertical boards mounted to a panel, creating the plurality of reflector rows 14. The spacing of the vertical reflector rows 14 reflects the pattern of radiation 24 of the back waves. The panel may be high and wide enough to create a reflector 10 capable to cover the listener position 20 in a room. The respective position of each board or surface on the flat panel may be determined by the distance from a chosen position 20 in a room in relation to the reflector 10 and its location between the speakers 12.

The present invention may further include a plurality of horizontal reflector rows 40. The plurality of horizontal reflector rows 40 may be formed from the first side 46 to the second side 48 and may be substantially parallel relative to one another. The plurality of horizontal reflector rows 40 may from a concave shaped front surface 12 from the top end to the bottom end. Therefore, the concave shape created by the plurality of vertical reflector rows 14 may be substantially perpendicular relative to concave shape created by the plurality of horizontal reflector rows 40. In such embodiments, the present invention may include a top reflector portion 32, a center reflector portion 34 and a bottom reflector portion 36.

The present invention may include speakers 16, including a first speaker 16 and a second speaker 16. The reflector 10 may be positioned so that the concave shaped front surface 12 is aligned with an acoustic center of the first speaker 16 and the second speaker 16 along a speaker and reflector alignment line 28. In certain embodiments, the reflector 10 may be placed at an equal distance between the pair of speakers 16. In certain embodiments, the reflector 10 may be positioned between the listener position 20 and a back wall 18. The position of the direct radiation 22 from the speakers 16 may be in sync with the captured back waves 24 reflected by the reflector 10 and thus, restoring the time and phase of the back waves 26 radiation into the listening room.

The reflector 10 may be made of any material that reflects waves below 1000 hz. The present invention may be made of a series of vertical boards that mimics the radiation pattern of the back waves. The reflectors 10 height and width may vary depending on the room and or speakers 12 to be used. In certain embodiments, each of the plurality of reflector rows 10 may include a width of ¾ of an inch for correct resolution.

Aligning the present invention with the acoustic center of the speakers achieves time and phase correction. Using a string, secure one end to the listening position using any method of attachment, such as tape, pins etc. In certain embodiments, a laser measuring device may be used and mounted on a tripod for greater accuracy. Pull the string tightly to reach the front baffle of the left speaker. Move to the right speaker holding the string maintaining the same length to reach the front baffle of the right speaker. Both speakers may be equidistant to the listening position. Keeping the string length unchanged, locate the reflector so that the end of the string touches the left and right corners of the reflector.

When music is played using the reflector there may be a center fill and more focus to the sound. If the transients appear overly sharp and exaggerated or the voice seems too forward and strident, the reflector may be moved backwards in small increments. If the opposite happens, the transients are dull and the voice is recessed, the reflector may be moved in increments toward the user. By trial and error, the user may reach the ideal location where time and phase is correct. Usually within a margin of 1½" lies the right location where all are in synch. Once the location is optimized it may be recorded and marked to avoid repeating the placement procedure.

It should be understood, of course, that the foregoing relates to exemplary embodiments of the invention and that modifications may be made without departing from the spirit and scope of the invention as set forth in the following claims.

What is claimed is:

1. A reflector comprising:

a first side, a second side, a top end, a bottom end, a front surface, and a rear surface, and a plurality of reflector rows wherein each reflector row comprises: a substantially flat face and is formed from the top end to the bottom end, wherein the plurality of reflector rows are substantially parallel relative to one another, and form a concave shape on the front surface from the first side to the second side.

2. The reflector of claim 1, wherein each reflector row comprises a face section and a riser section, wherein the face section of each reflector row forms a substantially parallel plane relative to one another.

3. The reflector of claim 1, wherein the plurality of reflector rows is a plurality of vertical reflector rows.

4. The reflector of claim 3, further comprising a plurality of horizontal reflector rows wherein each row is formed from the first side to the second side and is substantially parallel relative to one another, wherein the plurality of horizontal reflector rows form a concave shaped front surface from the top end to the bottom end.

5. The reflector of claim 4, wherein each horizontal reflector row comprises the face and a riser, wherein the face of each horizontal reflector row forms a substantially parallel plane relative to one another.

6. The reflector of claim 3, wherein each of the vertical reflector rows comprises a width of about ¾ of an inch.

7. The reflector of claim 4, wherein each horizontal reflector row comprises a width of about ¾ of an inch.

8. The reflector of claim 1, further comprising at least a first speaker and a second speaker, wherein the reflector is positioned so that the concave shaped front surface is aligned with the acoustic center of the first speaker and the second speaker.

9. A method of restoring the phase and time of sound waves comprising:

providing a reflector comprising a plurality of reflector rows forming a concave shaped front surface;

positioning the reflector in between at least a first speaker and a second speaker; and aligning the concave shaped front surface with the acoustic center of the first speaker and the second speaker.

10. The method of claim 9, wherein the plurality of reflector rows is a plurality of vertical reflector rows.

11. The method of claim 10, wherein the reflector further comprises a plurality of horizontal reflector rows forming a concave shape on the front surface substantially perpendicular relative to the concave shaped front surface formed by the plurality of vertical reflector rows.

12. The method of claim 9, wherein a width of each of the plurality of reflector rows is about ¾ of an inch.

13. The method of claim 9, wherein the reflector is positioned at an equal distance between the first speaker and the second speaker.

14. The method of claim 9, wherein the reflector is positioned at an ear level of a user.

15. The method of claim 9, wherein the reflector is positioned between a user position and a back wall.

16. A sound system comprising:

a reflector comprising a first side, a second side, a top end, a bottom end, a front surface, and a rear surface, and a plurality of reflector rows wherein each row is formed from the top end to the bottom end, and is substantially parallel relative to one another, wherein the plurality of reflector rows form a concave shape on the front surface from the first side to the second side; and at least a first speaker and a second speaker, wherein the reflector is positioned so that the concave shaped front surface is aligned with the acoustic center of the first speaker and the second speaker.

* * * * *